US008651124B2

(12) United States Patent
Damas

(10) Patent No.: US 8,651,124 B2
(45) Date of Patent: Feb. 18, 2014

(54) TENT WITH DIVIDABLE MATTRESS POCKET

(76) Inventor: Nage Colin Damas, Overland Park, KS (US)

( * ) Notice: Subject to any disclaimer, the term of this patent is extended or adjusted under 35 U.S.C. 154(b) by 0 days.

(21) Appl. No.: 13/287,236

(22) Filed: Nov. 2, 2011

(65) Prior Publication Data

US 2012/0125390 A1 May 24, 2012

Related U.S. Application Data

(60) Provisional application No. 61/416,488, filed on Nov. 23, 2010.

(51) Int. Cl.
*E04H 15/56* (2006.01)

(52) U.S. Cl.
USPC ..... 135/116; 135/115

(58) Field of Classification Search
USPC ..... 135/115, 116
See application file for complete search history.

(56) References Cited

U.S. PATENT DOCUMENTS

| | | | | |
|---|---|---|---|---|
| 2,259,267 | A | 10/1941 | Ranken | |
| 2,907,056 | A | 10/1959 | Kaplan | |
| 4,231,125 | A * | 11/1980 | Tittl | 5/419 |
| 4,590,956 | A | 5/1986 | Griesenbeck | |
| 4,605,029 | A * | 8/1986 | Russell | 135/125 |
| 4,757,832 | A | 7/1988 | Russell | |
| 4,852,598 | A | 8/1989 | Griesenbeck | |
| 5,615,521 | A | 4/1997 | Simerka | |
| 5,632,291 | A | 5/1997 | Botbyl et al. | |
| 5,640,725 | A * | 6/1997 | Ando et al. | 5/413 AM |
| 5,660,197 | A | 8/1997 | Boe et al. | |
| 5,699,820 | A | 12/1997 | Evans et al. | |
| 5,864,908 | A | 2/1999 | Kielman | |
| 5,913,322 | A | 6/1999 | Gallant et al. | |
| 6,167,898 | B1 | 1/2001 | Larga et al. | |
| 7,127,753 | B1 * | 10/2006 | Ramaley | 5/413 R |
| 7,178,483 | B2 * | 2/2007 | Wu | 119/498 |
| 7,392,555 | B2 | 7/2008 | Danaher | |
| 7,588,045 | B2 | 9/2009 | Goodwin et al. | |
| 2003/0106578 | A1 | 6/2003 | Cornist | |
| 2004/0065361 | A1 | 4/2004 | Pratt et al. | |
| 2005/0166951 | A1 | 8/2005 | Russo | |
| 2006/0021643 | A1 | 2/2006 | Brensinger | |
| 2006/0064818 | A1 | 3/2006 | Danaher | |
| 2006/0249190 | A1 | 11/2006 | Fritzsche et al. | |
| 2008/0216881 | A1 | 9/2008 | Ganz | |
| 2010/0083995 | A1 | 4/2010 | Sanders | |
| 2010/0101618 | A1 | 4/2010 | Van Aalst | |

* cited by examiner

*Primary Examiner* — Noah Chandler Hawk
(74) *Attorney, Agent, or Firm* — Erickson, Kernell, Derusseau & Kleypas, LLC

(57) ABSTRACT

A tent including an integrated vestibule and a sleeping chamber having a dividable pocket for receiving at least one mattress therein and a plurality of tie-downs for tightening up loose pocket panel material when a mattress is not contained therein. The dividable pocket further includes a fastener for optionally and selectively dividing the pocket into discreet sections or a single section.

20 Claims, 2 Drawing Sheets

TENT WITH DIVIDABLE MATTRESS POCKET

This application claims the benefit of U.S. provisional patent application Ser. No. 61/416,488, filed Nov. 23, 2010, under 35 U.S.C. §119(e).

BACKGROUND OF THE INVENTION

1. Field of the Invention

This invention relates generally to tents, and more particularly, to a tent having a vestibule and a system for securing mattresses in the tent.

2. Background & Description of the Related Art

Outdoor enthusiasts and campers have for many years used tents and mattresses to protect themselves and their belongings from the effects of the weather when camping and sleeping outdoors. Typically, tents are of unitary construction having a floor permanently secured to a dome-like roof which provides cover for the floor. After an individual sets up a tent or shelter, a mattress is often times placed on the tent floor to provide cushioning and an additional barrier from the cold floor surface.

A common problem with placing a mattress on the floor of the tent is difficulty in maintaining fixed placement of the mattress on the tent floor. A number of patents in the prior art have attempted to address this problem. For example, U.S. Pat. No. 5,642,750 to Brown et al. discloses a tent having an integral self-inflating floor. Similarly, U.S. Pat. No. 4,852,598 to Griesenbeck discloses a bed tent with a base portion snugly fitted around a mattress. Numerous mat devices have also been disclosed by the prior art such as U.S. Pat. No. 5,864,908 to Kielman. Kielman discloses a portable mat system for receiving and retaining a mattress thereby protecting and reducing movement of the mattress. However, mat devices are insufficient to fix the mattress on a tent floor relative to the tent walls. The prior art, whether related to tent floors or mat devices, generally provides for use of a single mattress of predetermined dimensions.

Tents are often occupied by various numbers of campers. For example, a single tent may comfortably accommodate two people or, alternatively, one person carrying many provisions. In the prior scenario, it is desirable to have a one large mattress or two smaller separated mattresses to allow the two campers to sleep comfortably. In the latter scenario, it is desirable to have one smaller mattress covering less than the entire area of the tent floor thereby allowing room for provisions to be set on the hard floor surface not occupied by the mattress.

There remains a need for a tent in which one or more mattresses can be secured in place relative to the tent floor.

SUMMARY OF THE INVENTION

A tent with a floor having a divisible floor pocket for selectively inserting various sized mattresses is provided to improve upon the shortcomings of the prior art. The tent generally comprises a sleeping chamber with an integrated or attached vestibule extending therefrom and a sleeping chamber divisible floor pocket for receiving at least one mattress.

The divisible floor pocket is divisible with a pocket dividing fastener preferably dividing the floor pocket into two equal mattress receiving areas. It is also foreseen that the floor pocket may be divided into two unequal areas. The pocket dividing fastener allows for a camper to place a mattress into one mattress receiving area while leaving the other receiving area empty, placing a mattress into each receiving area but separate by a recess formed by the pocket dividing fasteners, or placing a single large mattress that occupies the area of both mattress receiving areas combined. Tie-downs are further provided to take up or tighten loose fabric resulting from any configuration when one or both receiving areas do not contain a mattress.

DETAILED DESCRIPTION OF THE PREFERRED EMBODIMENTS

Figure 1:
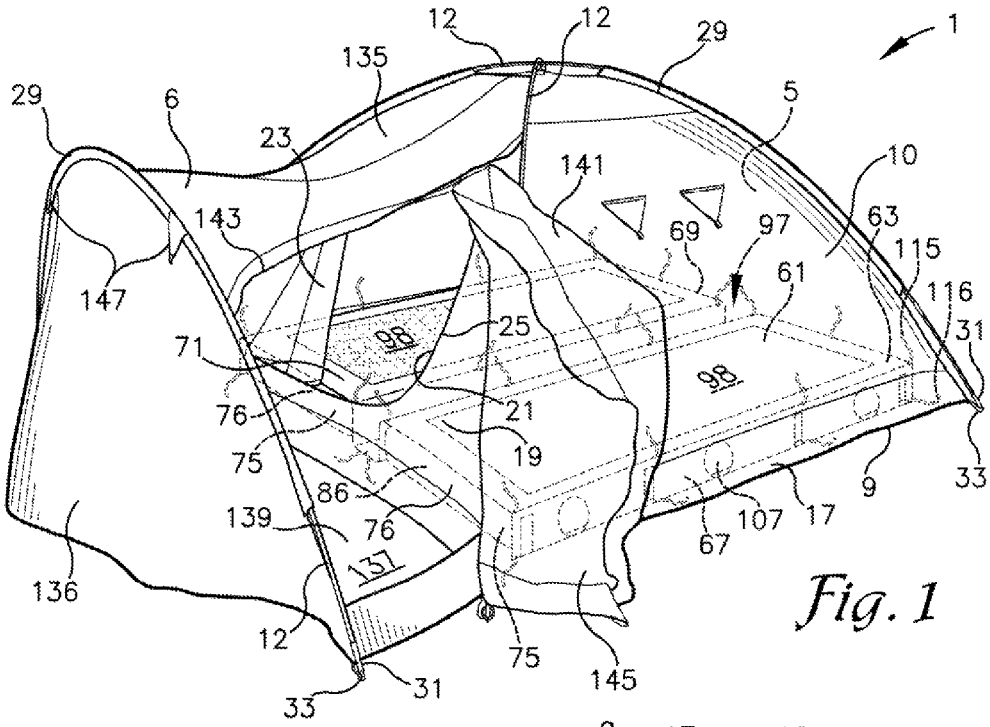
FIG. 1 is a perspective view of the tent.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring now to the Figures in more detail, there is shown an embodiment of the tent indicated generally by reference number 1. The tent 1 generally comprises a sleeping chamber 5 and an integrated enclosed vestibule 6 formed by a plurality of panels of flexible material sewn together in a manner well known in the prior art and need not be described in great detail. The material used for the panels forming the sleeping chamber 5 and vestibule 6 is preferably a non-permeable, moisture barrier material and may be made from any of known materials such as, but not limited to, polyester, cotton, vinyl, or any combination thereof.

Figure 3:
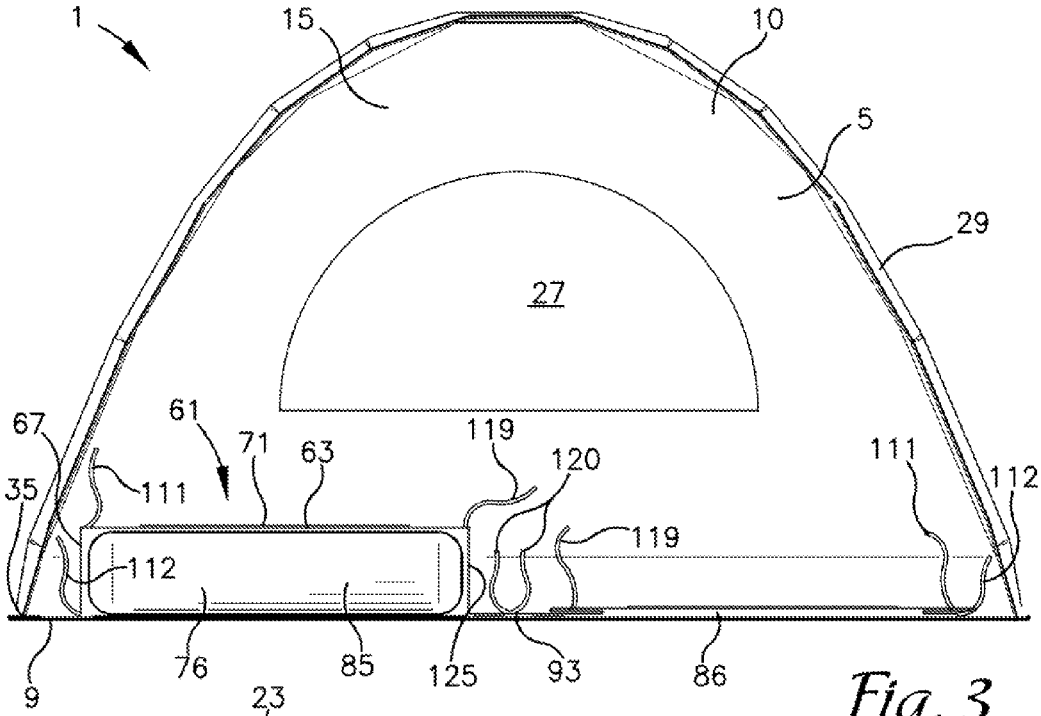
FIG. 3 is front cross-sectional view of the tent showing a mattress in one side of the dividable floor pocket.

The sleeping chamber 5 of the tent 1 comprises a sleeping chamber floor or rectangular base 9 and an upper shell 10. The upper shell 10 is supported in a conventional manner above the sleeping chamber floor 9 such as by resilient support rods 12 and generally forms a dome shape as shown in FIGS. 1 and 3. The upper shell 10 comprises a rear wall or panel 15, two side walls or side panels 17 and a front wall or entry panel 19. The front wall 19, rear wall 15 and side walls 17 are shown as generally triangular pieces of fabric. The side walls 17 are sewn or otherwise attached to opposite sides or edges of the rear wall 15. The front wall 19 is sewn or otherwise attached to front edges of the side walls 17 opposite the rear wall 15.

An access opening or passageway 21 is formed in the front panel 19 for entry into the sleeping chamber 5. A sleeping chamber door 23 is connected to the front panel 19 along an edge 25 of the passageway 21 by a zipper or hook and loop type fastener system or other appropriate fastener system to permit the sleeping chamber door to selectively cover and uncover the passageway 21. The sleeping chamber door 23 is preferably selectively unfastened from the front panel 19 to uncover the passageway 21 to allow a person to pass therethrough. The door 23 is preferably made from the same material as the walls 15, 17 and 19. The tent 1 preferably includes a mesh screen door (not shown) which is connected to the front panel 19 along edge 25 of passageway 21 by a fastener system which permits the screen door to be selectively connected to or disconnected from the front panel 19 inside of the sleeping chamber door 23. The screen door is similarly fastened to the edges 25 of the passageway 21 with a zipper or hook and loop fasteners so as to completely cover the passageway 21. It is foreseen that a camper may desire to unfasten the outer door 23 and fasten the inner door to allow ventilation through the sleeping chamber 5. It is foreseen that the upper shell portion 10 may be provided with vents and mesh areas for further ventilation of the sleeping chamber 5 such as a rear wall window 27.

The resilient support rods 12 used to support the upper shell 10 are received through support rod tent loops or sleeves 29 attached to the upper shell 10. Ends 31 of the resilient support rods 12 are received into a support rod receiver 33 to maintain the resilient support rods 12 in the desired position for supporting the upper shell 10 above the floor as shown in FIG. 1.

The sleeping chamber floor 9 extends across the entire base of the upper shell 10 and is understood to conform substantially in shape and size to the footprint of the sleeping chamber 5. The floor 9 is fixedly attached to the bottom, peripheral edge 35 of the shell 10. As is known in the art, the floor 9 of the sleeping chamber 5 may be formed from a water resistant sheet material that is more durable and thicker than the material forming the upper shell 10. It is also known to sew or otherwise assemble the sheet material forming the floor 9 to form relatively short, upstanding wall segments to which the material forming the upper shell is then attached.

A divisible pocket 61 is formed over or above the floor 9 by attaching a pocket panel assembly 63 about its periphery 65 to the interior of the sleeping chamber 5. The pocket panel assembly 63 includes side panels 67, rear panel 69, and a top panel 71. Bottom edges of the side and rear panels 67 and 69 attach to the floor 9 along the pocket panel periphery 65; wherein the pocket panel periphery 65 is smaller than the periphery of the sleeping chamber 5 and of the floor 9. As assembled, the divisible pocket 61 is formed with an open, mattress receiving side 73, defining a mattress receiving opening 75, for receiving at least one mattress 76 within the undivided area enclosed by the pocket panel assembly 63. The pocket 61 is particularly suited for receiving a portable mattress such as an air mattress with a plastic bottom to keep the air mattress from sliding around on the relatively smooth or slick floor 9 of the tent 1. However, it is to be understood that other types of mattresses could be positioned in the pocket.

Figure 2:
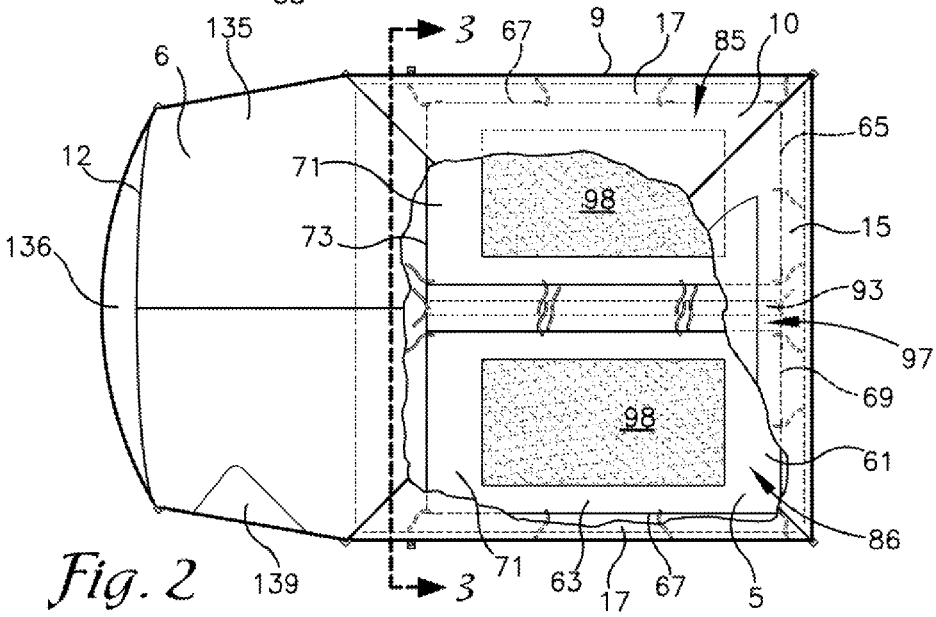
FIG. 2 is a top view of the tent with a cutaway showing the layout of the dividable floor pocket.
Figure 4:
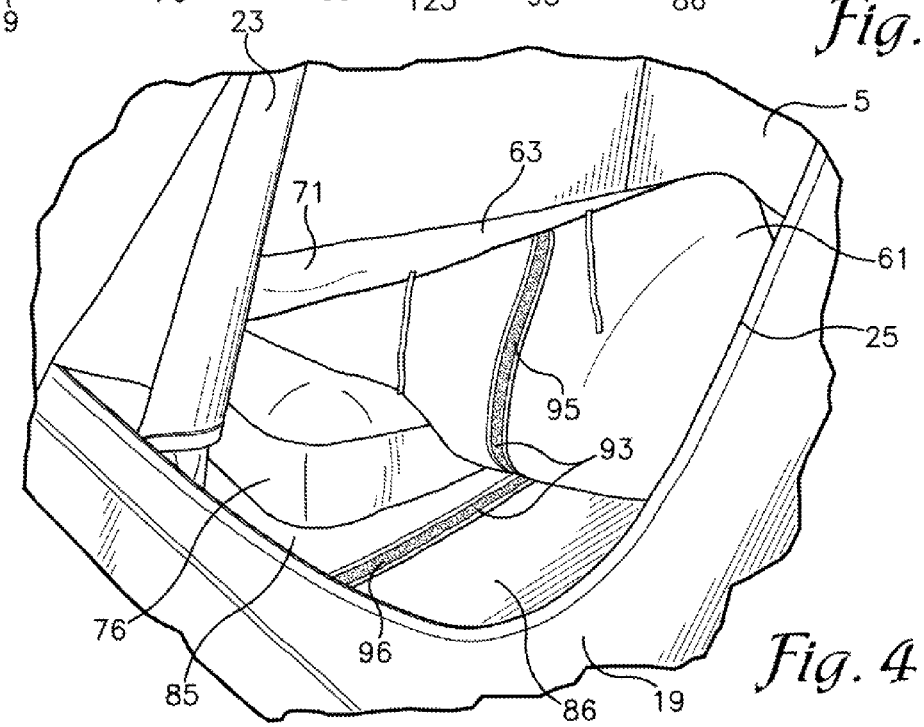
FIG. 4 is a perspective view of the interior of the tent with a mattress inserted into one side of the dividable floor pocket.

The undivided area enclosed by the pocket panel assembly 63 is sized to receive a mattress that is large enough to accommodate two people in a sleeping position such as a king or queen sized mattress. The area enclosed by the pocket panel assembly 63 is also divisible into two mattress receiving areas 85 and 86 using a pocket dividing fastener system 93 provided along a center line of the dividable pocket 61 parallel to the side walls 17 and transverse to the front wall 19 of the tent 1, as shown in FIGS. 2 and 4. The fastener system 93 shown comprises a hook-and-loop type fastener such as VELCRO, having a first portion 95 of the hook and loop fastener connected to an inner surface of the panel assembly top panel 71 and a second portion 96 of the hook and loop fastener connected to an upper surface of the floor 9. Pressing the first portion 95 of hook and loop fastener against the second portion 96 releasably secures the top panel 71 of pocket panel assembly 63 to the floor generally along a centerline thereof.

As shown in FIGS. 1-4, the divided mattress receiving areas 85 and 86 are each sized to receive a twin air mattress 76 sized to accommodate a single person in a sleeping position. It is foreseen that the pocket dividing fastener system 93 may be at a location other than the center line of the divisible pocket 61. For example, if it is desired to accommodate two different sized mattresses, the fastener system 93 may be located to size the mattress receiving areas 85 and 86 appropriately. It is also foreseen that a plurality of pocket dividing fasteners 93 may be used, such as, for example, two sets of hook-and-loop fastener strips. The pocket dividing fastener system 93 fastens the pocket panel assembly top panel 71 to the sleeping chamber floor 9 to create two distinct sleeping areas with a recess 97 extending therebetween. The fastener system 93 also snugly tightens the divisible pocket 61 around each respective mattress 76.

In a preferred embodiment, a non-skid panel or layer 98 is mounted or otherwise secured on the top panel 71 of the pocket panel assembly 63 above the left and right mattress receiving areas 85 and 86. The non-skid layer 98 are formed from a material having a greater coefficient of friction than the nylon fabric normally used in manufacturing tents to reduce sliding of a sleeping bag set on non-skid panel 98 extending over the top panel 71. The non-skid panels 98, may be formed from a mesh material such as the mesh material used to form the screen door for the tent. One such mesh material is 68D NO-SEE-UM MESH. It is also foreseen that the non-skid layer 98 could be formed by adhering a layer of a rubber type material over the left and right mattress receiving areas 85 and 86 of the pocket 61. It is also foreseen that the entire pocket panel assembly 63 could be formed from a non-skid material such as a mesh material or that the non-skid material could be secured across an opening in the material forming the rest of the pocket panel assembly 63.

Ventilation holes 107 are formed in the side walls 67 of the pocket panel assembly 63 to allow air flow into the pocket 61 to reduce the growth of mold and mildew therein and to access the mattress 76 to assist in moving the mattress relative to the pocket 61 and to increase the likely accessibility of any valves used to control inflation or deflation of the mattress 76. It is foreseen that sufficient space is provided between the side and rear walls 67, 69 of the dividable pocket 61 and the side and rear walls 17, 15 of the sleeping chamber 5 to allow for ventilation of the pocket 61.

FIG. 3 depicts a single mattress 76 received within only one mattress receiving area, namely left mattress receiving area 85. As in the previous configuration, the pocket dividing fastener system 93 fastens the top panel 71 to the sleeping chamber floor 9. In this configuration, the divisible pocket 61 is divided into two sections: a mattress section, defined by the leftward mattress receiving area 85, and a floor section defined by the rightward mattress receiving area 86. As shown, the fastener 93 snugly tightens the divided pocket 61 around the mattress 76 in the left mattress receiving section 85 while the divided pocket 61 of the right mattress receiving section 86 is loose. For the convenience and safety of the campers, tie-downs 111, 112, 115, 116, 119 and 120 are provided in order to take in the slack of the loose mattress receiving section 86 of the divided pocket 61, as explained further below.

Tie-downs 111, 112, 115, 116, 119 and 120 are attached to the pocket panel assembly 63. Tie-downs 111 and 112 are attached at the top and bottom edges of the side panels 67, respectively, in spaced relation along the length of the side panels 67. Tie-downs 115 and 116 are attached to the top and bottom edge of the rear panel 69, respectively, in spaced relation along the length of the rear panel 69. Tie-downs 119 are attached to the top panel 71 in parallel and spaced relationship to the fastener system 93, so that the tie downs extend along what would be considered a top edge of an inner sidewall 125 formed adjacent to the recess area 97 between the mattress receiving areas 85 and 86 when the pocket 61 is divided into two receiving areas 85 and 86 using the faster system 93. Tie-downs 120 are attached in spaced relation to the top panel 71 over the first portion 95 of the fastener system 93 connected thereto.

As shown in FIG. 3, the slack of the loose portion of the pocket 61 enclosing a receiving area 85 or 86 not used to receive a mattress 76, may be taken up by tying together the respective tie-downs associated therewith including tying together tie-downs 119 to tie-downs 120, tie-downs 115 to tie-downs 116, and tie-downs 111 to tie-downs 112 whereby the slack of the loose pocket panel assembly 63 is tightened or taken up. It is also foreseen that a camper may desire not to put any mattresses within the divisible pocket 61. In such a configuration, the slack of the entire pocket panel assembly 63 may be taken up by tying together tie-downs 111 to tie-downs 112 and also tying together tie-downs 115 to tie-downs 116.

The vestibule 6 extends outward from the sleeping chamber 5 and forward of the front wall 19 of the upper shell 10. The vestibule 6 comprises vestibule main panel or central panel 135, a vestibule end panel 136 and a vestibule floor 137. Each of these panels may be formed from a plurality of smaller sections of material. The vestibule main panel 135 is generally arcuate and forms the roof and side walls of the vestibule 6 with a vestibule access opening or passageway 139 formed through one side of the vestibule main panel 135 so as to open to one side of the tent 1. End wall 136 extends across an outer peripheral edge of vestibule main panel 135 to form the end of the vestibule.

A vestibule door 141 releasably fastens to a peripheral edge 143 of the vestibule main panel 135 defining an access opening 139 with a zipper or hook and loop type fastener to selectively cover the access opening 139. The vestibule door 141 is selectively and partially unfastened from the peripheral edge 143 to open the access opening 139 a sufficient amount to allow a person to pass through the access opening 139. The vestibule door 141 is preferably made from the same material as the walls 135 and 136. The vestibule 6 preferably includes a mesh inner door 145 which is also removably attachable to the peripheral edge 143 of the vestibule main panel 135 around the access opening 139 and inside of the vestibule door 141. The mesh inner door 145 is similarly fastened to the peripheral edge 143 of the passageway 139 with a zipper or hook and loop type fastener so as to completely cover the passageway 139. It is foreseen that a camper may desire to unfasten the vestibule door 141 and fasten the inner, mesh door 145 to allow ventilation through to the sleeping chamber 5. It is foreseen that the vestibule 6 may be provided with vents and mesh areas for further ventilation of the vestibule 6.

The vestibule end wall 136 is supported by a resilient support rod 12. Similar to the resilient support rods 12 of the upper shell 10, the resilient support rod 12 is received through support rod tent loops or sleeves 29 attached to the vestibule end wall 136. The ends 31 of each resilient support rod 12 are received into a rod receiver 33 to maintain the resilient support rods 12 in the desired position as generally shown in FIG. 1 for the embodiment disclosed. Guy line connectors 147 are sewn or otherwise attached to the end wall 136 or the sleeves 29 formed thereon. The base or floor 137 of vestibule 6 is narrower than the portion of the main panel 135 forming the roof of the vestibule 6. The weight of the support rod 12 connected to and supporting end wall 136 causes the upper curved portion of the support rod 12 to lean away from the front panel 19 of the sleeping chamber 5. Guy lines (not shown) connected to the guy line connectors 147 can be used to hold the support rod for the vestibule end wall 136 in the orientation as shown in FIG. 1. The portion of the tent forming the vestibule 6 may be secured to the ground using stakes to help maintain the desired geometry of the vestibule 6.

When the tent 1 is not in use, and with the support rods 12 removed, the tent 1 can be rolled up and stored in a bag (not shown). The bag is preferably sized to receive the tent 1 rolled up with the air mattress or mattresses 76 deflated and left in the pocket 61 or pocket receiving areas 85 and 86. The bag is preferably sized to also receive a pump (not shown).

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A tent having a floor and an upper shell, the improvement comprising:

a pocket formed by a pocket panel connected to said tent on an interior thereof and extending over said floor, an outer surface of said pocket panel including a non-skid portion, said pocket sized to receive at least one portable mattress therein and having at least one access opening extending between said pocket panel and said floor along one side of said pocket panel and sized to permit said portable mattress to pass through said access opening and into and out of said pocket; and a fastener releasably connecting a portion of an underside of said pocket panel to said floor to divide said pocket into at least two sections; each section sized to receive a portable mattress.

2. The tent as in claim 1 wherein said fastener extends transverse to said access opening of said pocket.

3. The tent as in claim 1 wherein said fastener comprises a first portion of said fastener connected to said floor and a second portion of said fastener connected to said pocket panel, said first and second portions of said fastener operable to connect said pocket panel to said floor.

4. The tent as in claim 3 wherein said first portion of said fastener comprises a first portion of a hook and loop type fastener and said second portion of said fastener comprises a second portion of said hook and loop type fastener.

5. The tent as in claim 4 wherein said first and second portions of said hook and loop type fastener extend transverse to said access opening.

6. The tent as in claim 1, wherein ventilation openings are formed in said pocket panel.

7. The tent as in claim 6 wherein said ventilation openings are formed around a periphery of said pocket.

8. The tent as in claim 1, wherein a first hold-down is connected to extend from the outer surface of said pocket panel near but spaced apart from a perimeter of said pocket panel and a second hold-down is connected to said floor of said tent and said first and second hold-downs may be connected together to reduce slack in said pocket panel relative to said tent floor.

9. The tent as in claim 1, wherein the non-skid portion on the outer surface of said pocket panel resists slipping of a sleeping bag relative thereto.

10. A tent comprising a floor and an upper shell enclosing a sleeping chamber;

said upper shell including a front panel having a sleeping chamber access opening formed therethrough and a sleeping chamber door panel connected to said front panel and selectively covering said sleeping chamber access opening;

a pocket formed by a pocket panel connected to said floor of said tent along three sides of said pocket panel and extending over said floor, said pocket having a pocket access opening formed between said pocket panel and said floor along a side of said pocket panel closest to said front panel; said pocket sized to receive through said pocket access opening a portable mattress sized to accommodate two people in a sleeping position;

a fastener disposed on an underside of said pocket panel between said pocket panel and said floor and spaced inwardly from the sides of the pocket panel, the fastener releasably connecting a portion of said underside of said pocket panel to said floor to divide said pocket into at least two sections with each section having a reduced access opening providing access into said section of said pocket; each section of said pocket sized to receive through said reduced access opening a portable mattress sized to accommodate a single person in a sleeping position.

11. The tent as in claim 10 wherein said fastener comprises a first portion of said fastener connected to said floor and a second portion of said fastener connected to said pocket panel, said first and second portions of said fastener operable to connect said pocket panel to said floor.

12. The tent as in claim 11 wherein said first portion of said fastener comprises a first portion of a hook and loop type fastener and said second portion of said fastener comprises a second portion of said hook and loop type fastener.

13. The tent as in claim 12 wherein said first and second portions of said hook and loop type fastener extend transverse to said access opening.

14. The tent as in claim 10, wherein ventilation openings are formed in said pocket panel.

15. The tent as in claim 14 wherein said ventilation openings are formed around a periphery of said pocket.

16. The tent as in claim 10, wherein a first hold-down is connected to said pocket panel near a perimeter of said pocket panel and a second hold-down is connected to said floor of said tent and said first and second hold-downs may be connected together to reduce slack in said pocket panel relative to said tent floor.

17. The tent as in claim 10 wherein an upper surface of said pocket panel includes a section of skid resistant material on an upper surface thereof to resist slipping of a sleeping bag relative thereto.

18. A tent having a floor and an upper shell, the improvement comprising:

a pocket formed by a pocket panel connected to said tent on an interior thereof and extending over said floor, the pocket panel consisting essentially of a layer of fabric, said pocket sized to receive at least one portable mattress therein and having at least one access opening extending between said pocket panel and said floor along one side of said pocket panel and sized to permit said portable mattress to pass through said access opening and into and out of said pocket; and a fastener releasably connecting a portion of an underside of said pocket panel to said floor to divide said pocket into at least two sections, each section sized to receive a portable mattress.

19. The tent of claim 18 further comprising:

a non-skid member applied on a top outer surface of the pocket panel.

20. The tent of claim 18 further comprising:

a non-skid member attached to a top outer surface of the pocket panel.

* * * * *